United States Patent [19]

Ferguson et al.

[11] Patent Number: 4,767,479

[45] Date of Patent: Aug. 30, 1988

[54] METHOD FOR BONDING CERAMIC CASTING CORES

[75] Inventors: T. Arnold Ferguson, Manchester; Linda L. Seaver, Bristol, both of Conn.

[73] Assignee: United Technologies Corporation, Hartford, Conn.

[21] Appl. No.: 99,272

[22] Filed: Sep. 21, 1987

[51] Int. Cl.[4] ..... B32B 18/00

[52] U.S. Cl. ..... 156/89; 156/242; 156/245; 264/60; 264/62; 264/63; 264/328.2

[58] Field of Search ..... 156/89, 242, 245; 264/60, 62, 63, 328.1, 328.2

[56] References Cited

U.S. PATENT DOCUMENTS

| | | | |
|---|---|---|---|
| 124,559 | 3/1872 | Elliott et al. . | |
| 3,189,504 | 6/1965 | Whittle et al. | 156/89 |
| 3,231,401 | 1/1966 | Price et al. | 106/57 |
| 3,234,308 | 2/1966 | Herrmann | 264/63 |
| 3,239,323 | 3/1966 | Folweiler | 156/89 |
| 3,287,476 | 11/1966 | Snyder | 264/36 |
| 3,423,216 | 1/1969 | Somers | 106/38.35 |
| 3,719,550 | 3/1973 | Arendt | 156/89 |
| 3,736,222 | 5/1973 | Arendt | 156/89 |
| 3,953,562 | 4/1976 | Hait et al. | 264/63 |
| 3,957,715 | 5/1976 | Lirones et al. | 260/37 SB |
| 4,221,748 | 9/1980 | Pasco et al. | 264/43 |
| 4,247,580 | 1/1981 | Chao | 427/140 |
| 4,345,955 | 8/1982 | Bakermans et al. | 156/89 |
| 4,364,783 | 12/1982 | Theodore et al. | 156/89 |
| 4,419,162 | 12/1983 | Fischer | 156/94 |
| 4,427,742 | 1/1984 | Willgoose et al. | 428/338 |
| 4,526,636 | 7/1985 | Mader | 156/94 |

FOREIGN PATENT DOCUMENTS

| | | | |
|---|---|---|---|
| 46110 | 5/1971 | Japan . | |
| 1014180 | 1/1986 | Japan | 156/89 |
| 1014179 | 1/1986 | Japan | 156/89 |

*Primary Examiner*—Caleb Weston

*Attorney, Agent, or Firm*—James M. Rashid

[57] ABSTRACT

The surface of green (unsintered) casting cores which contain ceramic particles and a thermoplastic binder are bonded to each other by softening the binder in each core and applying a layer of ceramic particles to the surface of at least one of the cores to be joined, assembling the cores to each other such that the core surfaces are in close contact with each other; causing the binder to reharden; and then heating the cores to volatilize the thermoplastic binder and to sinter the ceramic particles in the cores to each other.

4 Claims, No Drawings

METHOD FOR BONDING CERAMIC CASTING CORES

TECHNICAL FIELD

This invention generally relates to cast metals. In particular, it relates to cores used to make metal castings. Most particularly, the invention relates to a method for bonding green ceramic cores to each other.

BACKGROUND

Ceramic cores are widely used in the casting of metal components. See, e.g., U.S. Pat. Nos. 3,957,715 to Lirones et al and 4,221,748 to Pasco et al. The cores are typically made by techniques such as injection molding or transfer molding. In such processes, a mixture of ceramic particles and a binder are forced into a die having a shape which corresponds to the desired shape of the core. The resulting green (unsintered) core is then heated to a high temperature to drive off the binder and to sinter the ceramic particles to each other, as described in U.S. Pat. No. 3,234,308 to Herrmann.

Ceramics which are useful in making cores include simple oxides such as aluminum oxide (alumina) and silicon dioxide (silica), as well as complex oxides such as zirconium orthosilicate (zircon), aluminum silicate (mullite), and magnesium aluminate (spinel). Core properties are often optimized by incorporating a mixture of different types (i.e., compositions) of ceramic particles in the core. The particles are usually in the form of powders, although ceramic fibers can also be used to make cores. See, e.g., U.S. Pat. No. 4,427,742 to Willgoose et al and commonly assigned U.S. patent application Serial No. 018,113 to Roth. This patent applica- and issued patents noted above are all incorporated by reference.

The nature of the injection and transfer molding processes (as well as other processes which are used in fabricating cores) sometimes limits the size and/or configuration of cores which can be made. Accordingly, the casting industry constantly strives to develop improved methods for making cores. This invention seeks to satisfy the needs of the industry.

SUMMARY OF THE INVENTION

This invention relates generally to the fabrication of casting cores which contain ceramic particles and a thermoplastic binder. More specifically, it relates to a method for chemically bonding (as opposed to mechanically joining) the surfaces of two or more unsintered cores to each other so that in combination with a subsequent sintering operation, a fused core having features not readily fabricable with conventional molding processes is produced. The invention includes the steps of (a) softening the thermoplastic binder in the cores to be joined; (b) to at least one of the cores, applying a layer of ceramic particles to the surface which is to be joined to the surface of another core, the particles having a composition similar to the overall composition of the core to which they are applied; (c) while the binder is soft, assembling the cores into contacting relation with each other with the layer of ceramic therebetween, and then hardening the binder in the cores to form a green, bonded core; and (d) heating the bonded core to volatilize the binder and sinter the ceramic particles in the core to each other.

The term "thermoplastic binder" is used in the conventional sense, and is intended to describe natural as well as synthetic polymeric materials which are solid at room temperature and are capable of repeated softening at elevated temperatures. Thermoplastic materials may also be softened when contacted by various types of chemical solvents. The ability of thermoplastic binders to become moldable by the application of heat and softened by the application of solvents makes them particularly useful in the fabrication of cores according to this invention.

In a preferred embodiment of the invention, the surfaces of two green investment casting cores are bonded by first, applying onto each surface a mixture of ceramic particles and a liquid solvent capable of softening the binder present in the core. The applied ceramic particles have the same composition and are in the same ratio as the ceramic particles in each core. While the binder is soft, the cores are held together such that the surfaces which were treated with ceramic and solvent are in close contact with each other. During the time that the cores are in contact, some of the soft binder is drawn into the interface between the cores, apparently as a result of diffusion or capillary type action. When the solvent is removed (e.g., by volatilization) the binder hardens and binds the newly added ceramic particles to each core, and both cores to each other, thereby forming a single green bonded core. The bonded core is then heated to a relatively low temperature to volatilize the binder and any remaining solvent, and then to a much higher temperature to sinter the ceramic particles in the core to each other.

Other features and advantages of this invention will become more apparent in light of the following description, which includes a description of the preferred embodiment of the invention.

BEST MODE FOR CARRYING OUT THE INVENTION

As noted in the Background section, several types of cores are used in the investment casting industry, and specialized techniques are used for making them. This invention specifically relates to cores which utilize thermoplastic binders to bind the ceramic particles (the term "ceramic particles" is meant to describe ceramic powders as well as ceramic fibers) to each other in the green state, i.e., before the core is sintered. The invention is particularly useful in producing cores which have a complex configuration, the type of configuration which is not readily producible using conventional molding processes. See, e.g., the aforementioned patent application to Roth.

Green cores which are bonded according to this invention comprise a substantially uniform mixture of two major constituents: ceramic particles and thermoplastic binder. During the process of fabricating the individual green cores, a mixture of ceramic particles and binder is heated and molded, e.g., by injection or transfer molding techniques, in a die having a cavity which corresponds to the desired shape of the core. The temperature of the molding process is high enough to soften the binder, causing it to flow under pressure and become uniformly distributed among the ceramic particles. As the core cools, the binder hardens, causing the ceramic particles to adhere to each other.

The presence of thermoplastic binder in the core is the key feature which permits individual cores to be bonded to each other according to this invention. Thermoplastic binders can be readily softened by the application of heat or by contact with an appropriate chemical solvent. When the softening agent (heat or solvent) is applied locally to the core surface, the binder becomes locally softened both at and below the surface. While the binder is softened, a layer of ceramic particles is applied onto the surface of at least one, preferably both, of the cores to be joined, i.e., at the faying surface of each core. The cores are then pressed together and held in contact with each other. When the binder hardens (after the softening agent is removed), the cores are bonded together with the layer of particles therebetween. The formation of the bond between the cores suggests that some of the softened binder is drawn by diffusion mechanisms or capillary type action into the interface between each core, and then hardens in the interface. After the binder in the composite bonded core is fully hardened, the bonded core is heated to a first temperature to volatilize the binder, and then heated to a second, higher temperature to sinter the ceramic particles to each other.

Tests have shown that the binder must be softened and additional ceramic particles applied to each faying surface to obtain the best bond between the cores. If additional particles are applied without any softening of the binder, the bond is weak and the core will not be useful. And, if the binder is softened but no additional ceramic particles are applied to the faying surface, the bonding effort will be ineffective.

The invention is applicable to all core systems which utilize thermoplastic binders. One ceramic composition range (by weight percent) for cores which utilize thermoplastic binders is as follows: 10–50 zircon, 1–20 alumina, balance silica. Typically, the binder in such cores is present in amounts which range from between about 10 to 20% (as a percentage of total ceramic weight).

The specific method used to soften the binder will depend upon the specific type of binder used to make the core. While heat will cause thermoplastic binders to soften, the use of volatilizable solvents is preferred, because they are easier to apply to the core. Whatever softening agent is used, it should not cause the binder to decompose or to volatilize, and it should not cause the core to distort or to otherwise change its size or shape. The softening agent is preferably applied only to the desired bond surface.

When liquid organic solvents (such as toluene, benzene, or hexane) or halogenated solvents (such as trichloroethane or methylene chloride) are used to soften the binder in the green core, the solvent is applied directly to the surface of each core which is to be bonded to another core. Once the binder in each core has softened, the ceramic filler material is applied to at least one of the surfaces. Preferably, the solvent and particles are applied simultaneously to both surfaces, for example, by brushing a mixture of the solvent and ceramic particles onto the surfaces. The best results are obtained when at least one layer (i.e., one application) of the filler material is deposited on the faying surface of each core. Immediately after the surface of each core has been treated with the mixture of ceramic and solvent, the cores are placed in a fixture or other suitable device which holds the cores in close contact with each other and maintains their alignment with respect to each other. As the solvent volatilizes, the binder rehardens, and binds the cores to each other.

The core is then heated to sinter the ceramic particles to each other, after which the core is inspected. Visual or radiographic techniques are among those which can be utilized. In many cases, visual inspection will be adequate, and the success of the repair will be readily apparent.

The invention may be better understood by reference to the following example, which is meant to illustrate the features of the invention and not limit its scope. Two green ceramic casting cores containing ceramic particles and a thermoplastic binder were prepared by injection molding, using techniques known to those skilled in the art. The cores were made up of about 28% zirconium orthosilicate, 3% aluminum oxide, balance silicon dioxide. The zirconium orthosilicate and silicon dioxide particles were generally −325 mesh (U.S. Sieve Series) powder particles; the aluminum oxide particles were in the form of high aspect ratio fibers. The binder constituents were primarily paraffin and ceresin wax and were present in an amount which corresponded to about 14% of the total weight of the ceramic mixture. Minor amounts of aluminum stearate and oleic acid were also present to aid in the injection molding process. The cores were bonded to each other in the following manner: a blend of the ceramic constituents, in the same proportion as present in the cores, were added to 1-1-1 trichloroethane. The ceramic-solvent mixture was brushed onto the bond surface of each core, then the cores were assembled in a fixture and held tightly against each other. After the majority of the trichloroethane appeared to have volatilized, the cores were removed from the fixture. Visual examination revealed the cores to be bonded to each other. The bonded core was then slowly heated in an air atmosphere to about 540° C. (1,000° F.) to volatilize the binder, and then, to about 1,230° C. (2,250° F.) to cause the ceramic particles in the cores and at the bond line to sinter to each other. The temperature of the furnace was then reduced back to room temperature, and the sintered core removed. Inspection revealed that the new core had acceptable characteristics.

Although this invention has been shown and described with respect to a preferred embodiment, it will be understood by those skilled in the art that various changes in form and detail thereof may be made without departing from the spirit and scope of the claimed invention.

We claim:

1. A method for bonding the surfaces of two green ceramic casting cores to each other, each core containing ceramic particles and thermoplastic binder, comprising the steps of: softening the binder at the surface of each core; applying a layer of ceramic particles to said surface of at least one core; while the binder is soft, assembling said surfaces of each core together; and heating the assembled cores to volatilize the binder and to sinter the ceramic particles to each other.

2. The method of claim 1 comprising the step of softening the binder in each core by applying a liquid solvent to the core surface.

3. The method of claim 2, comprising the step of simultaneously applying the solvent and ceramic particles to the core surface.

4. A method for making a sintered ceramic casting core, comprising the steps of: injection molding ceramic particles and a thermoplastic binder into a cavity to form a green casting core, the ceramic particles and binder substantially uniformly distributed throughout the core; applying a volatilizable liquid solvent and ceramic particles to the surface of at least two of such cores, wherein the solvent softens the binder therein;

assembling the cores together to form a core assembly while the binder is soft, such that the solvent and ceramic particle treated surfaces are in contact with each other; volatilizing the solvent, wherein the binder hardens and binds the ceramic cores in said assembly to each other; and heating the core assembly to volatilize the binder and to sinter the ceramic particles in each core to each other.

* * * * *